US005315795A

United States Patent [19]

Chae et al.

[11] Patent Number: 5,315,795

[45] Date of Patent: May 31, 1994

[54] DEPLOYABLE/RETRACTABLE TELESCOPING MAST ASSEMBLY AND METHOD

[75] Inventors: Daniel S. H. Chae, Goleta; David J. Rohweller, Ojai; Mark W. Thomson, Ventura, all of Calif.

[73] Assignee: Astro Aerospace Corporation, Carpinteria, Calif.

[21] Appl. No.: 862,009

[22] Filed: Apr. 1, 1992

[51] Int. Cl.[5] ..... B66C 23/06

[52] U.S. Cl. ..... 52/113; 52/111; 403/109; 343/874; 343/901

[58] Field of Search ..... 52/110, 111, 113, 114, 52/118, 123.1, 651.09; 343/874, 901, 902, 903; 403/109, 328

[56] References Cited

U.S. PATENT DOCUMENTS

| | | | |
|---|---|---|---|
| 2,888,111 | 5/1959 | Evans | 52/114 |
| 3,474,833 | 10/1969 | Garrette, Jr. et al. | 403/109 X |
| 4,047,821 | 9/1977 | Hoke et al. | 403/109 |
| 4,079,978 | 3/1978 | McMullin | 403/109 X |
| 4,385,849 | 5/1983 | Crain | 343/901 X |

OTHER PUBLICATIONS

Astro Aerospace Corporation Telescopic Design presented at Lockheed Missiles & Space Company by Rohweller et al.

ERM, The Deployable Mast for Columbus by Reiger, publication date unknown.

Astro Telescopic Boom sheet of Astro Aerospace's capabilities brochure 1991.

*Primary Examiner*—Carl D. Friedman
*Assistant Examiner*—Kien Nguyen
*Attorney, Agent, or Firm*—Spensley Horn Jubas & Lubitz

[57] ABSTRACT

A deployable and retractable, telescoping style mast assembly and method employs a plurality of tubular sections of differing diameters. The tubular sections are nested one-in-another and are slidable with respect to each other, in a telescoping manner, to provide a deployable/retractable telescoping mast assembly. Retractable pins are provided to retractably extend from a collar coupled to at least one of the tube sections. In their extended state, the retractable pins are adapted to extend through apertures provided in an adjacent tube section. The retractable pins are provided with a head at one end thereof. The head of each pin is adapted to be engaged by a guide coupled to a third tube section upon the third tube section being in a collapsed state. Upon engagement with the pin head, the guide operates to pull the pin into a retracted state so as to retract the pin out of the pin receiving aperture.

29 Claims, 9 Drawing Sheets

DEPLOYABLE/RETRACTABLE TELESCOPING MAST ASSEMBLY AND METHOD

BACKGROUND

1. Field of the Invention

The present invention relates to a mast assembly and method and, in particular embodiments, a deployable and retractable, telescoping style mast assembly and method.

2. Related Art

Mast structures are designed to provide necessary strength and/or stiffness in applications requiring beam, cantilever, or column support. Mast structures are used in a variety of contexts, such as for supporting equipment or other structures at a distance from the body of a space craft, as support structures in various Earth based or water based vehicles or structures and as antennae structures, to name a few. Deployable type of mast structures combine these capabilities with a low stowable volume and the ability to actuate or deploy as required.

One method for constructing a deployable mast incorporates the telescoping tube concept. Telescoping tube type mast structures are widely used for existing nonspace application. For example, typical automobile antennae structures employ telescoping tube type masts. Such telescoping tube structures employ a number of segmented tube lengths which nest within each other. In the stowed state, the total length of the telescoping mast is generally the length of the outermost tube segment. In the deployed state, the total length equals the sum of each segment length minus the overlap between the tube segments. This overlap provides the means for reliable deployment and/or retraction, and with the tubes latched to each other, the overlap insures the capability to carry bending loads. In addition, if the tip deflection due to dead band is to be minimized, the gap space between the inner and out tubes must be small.

In certain applications, various conventional mast structures may be inadequate. For example, many conventional mast structures may be too large or heavy for certain applications or may be too easily collapsed or retracted under their own weight, external forces, or damage from impacting particles. For certain aerospace applications, where considerable importance is placed on size, mass, packaging size, the ability to restow, or damage tolerance, the tubes must have a minimal overlap and a reliable redundant mechanism to latch the mast in a deployed state and unlatch the mast for retraction. Additionally for certain applications, minimizing tube overlap reduces weight.

SUMMARY OF THE DISCLOSURE

The present invention relates to a mast assembly and method and, in particular embodiments, a deployable and retractable, telescoping style mast assembly and method. Embodiments of the invention employ a plurality of tubular sections of differing diameters. The tubular sections are nested one-in-another and are slidable with respect to each other, in a telescoping manner, to provide a deployable/retractable telescoping mast assembly. Retractable pins are provided to retractably extend from the outer peripheral wall of a collar coupled to at least one of the tube segments. In their extended state, the retractable pins are adapted to extend through apertures provided in an adjacent tube segment. The retractable pins are provided with a head at one end thereof. The head of each pin is adapted to be engaged by a guide provided on a third tube section upon the third tube section being in a collapsed state. Upon engagement with the pin head, the guide operates to pull the pin into a retracted state so as to retract the pin out of the pin receiving aperture.

According to further embodiments of the invention, the pin head is provided with a conical extension adapted to engage a detent portion provided in the pin guide so as to lock the tube section having the pin guide with the tube section having the pin when the tube section having the pin guide is in a retracted state. In further embodiments, a guide rail along the tube aligns each tube rotationally as required. A high-force bi-stem actuator is employed for driving the mast assembly between retracted and deployed states. The actuator employs two high-strength ribbons which are connected at one end to the innermost tube section and are wound about rotatable spools in a motor assembly. A motor is actuated to rotate the spools to either wind or unwind the ribbon to, thereby, retract or deploy, respectively, the mast assembly.

BRIEF DESCRIPTION OF THE DRAWINGS

The detailed description of embodiments of the invention will be made with reference to the accompanying drawings, wherein like numerals designate corresponding parts in the several figures.

DESCRIPTION OF THE PREFERRED EMBODIMENTS

The following detailed description is of the best presently contemplated mode of carrying out the invention. This description is not be taken in a limiting sense, but is made merely for the purpose of illustrating general principles of embodiments of the invention. The scope of the invention is best defined by the appended claims.

Figure 7A:
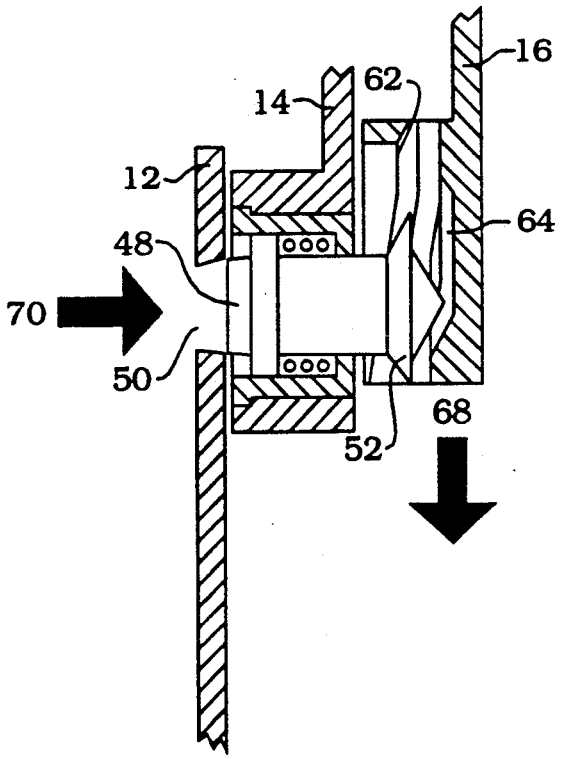
FIGS. 7A and B are partial cross-section views of three tube sections of the FIG. 1 embodiment and a side-view of a pin assembly, showing a mast retraction operation.
Figure 7B:
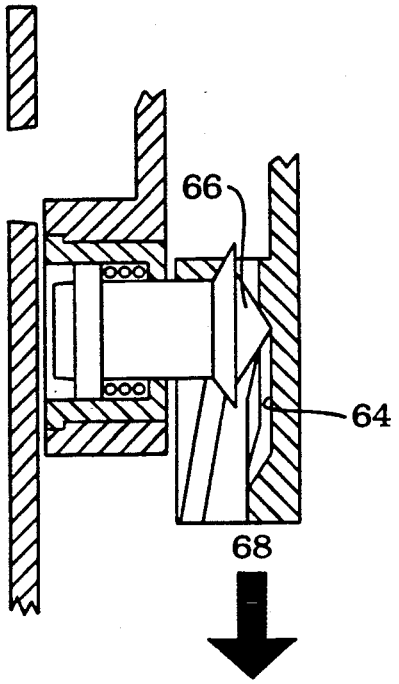
Figure 8:
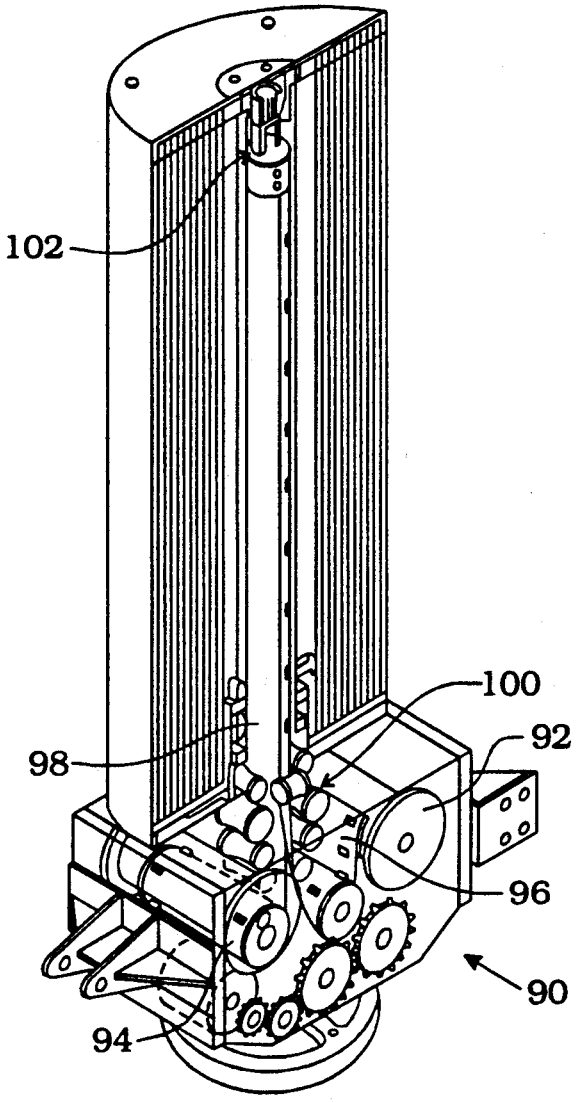
FIG. 8 shows a partial cut-away view of a mast assembly, including a motor drive, in a retracted state.
Figure 9:
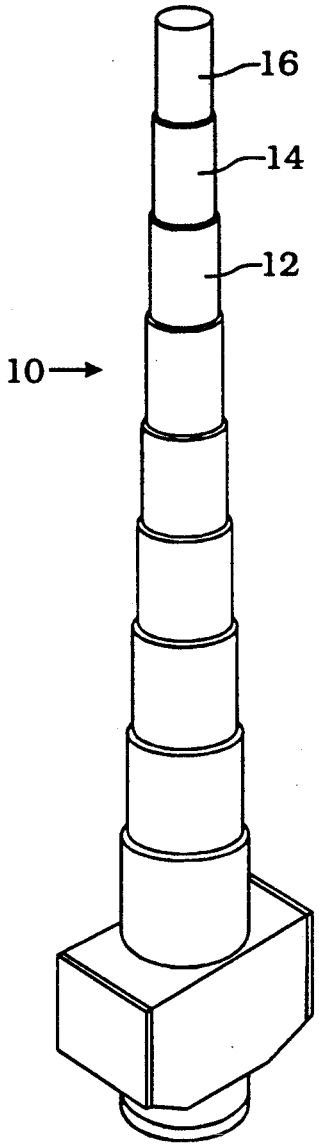
FIG. 9 shows a perspective view of a deployed mast assembly, including a motor drive.

Embodiments of the present invention relate to a telescoping type mast assembly which includes a plurality of tubular sections of differing diameters, which are nested within each other and are slidable with respect to each other in a telescoping manner to provide a deployable and retractable mast, and a guide rail to provide rotational alignment. An embodiment of a deployed mast assembly, including a motor drive is shown in FIG. 9. FIG. 8 shows a mast assembly, including a motor drive, in a retracted state. Embodiments of the present invention also relate to a method of deploying and retracting a telescoping type mast assembly such as shown in FIGS. 8 and 9. Various features of mast assemblies and methods, according to embodiments of the present invention, are discussed below with respect to FIGS. 1-9. While various aspects of the embodiments shown in FIGS. 1-9 are particularly well suited for use in aerospace applications, it will be understood that the mast assemblies and methods disclosed herein are suitable for various other applications, including earth, and water and under-water applications as well.

The mast assembly 10 shown in FIG. 9 includes a plurality of tubular sections of mutually different outer diameters, arrangeable one-inside-another and movable in a telescoping manner between retracted and deployed states (deployed states in FIG. 9). While the FIG. 9 assembly shows nine tubular sections, it will be understood that other embodiments may employ less or more tubular sections. For purposes of clarity, the description below (with respect to FIGS. 1-7) is made with respect to three tubular sections 12, 14 and 16, which may be, for example, the top three tubular sections in FIG. 9.

Figure 1:
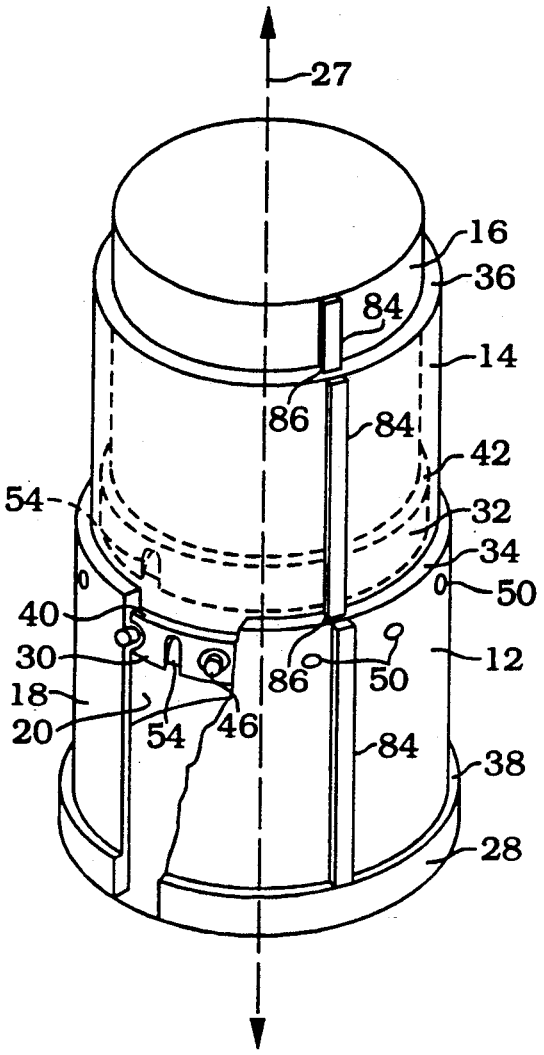
FIG. 1 is a perspective, partial cut-away view of three tube sections of a mast assembly according to an embodiment of the present invention.
Figure 2:
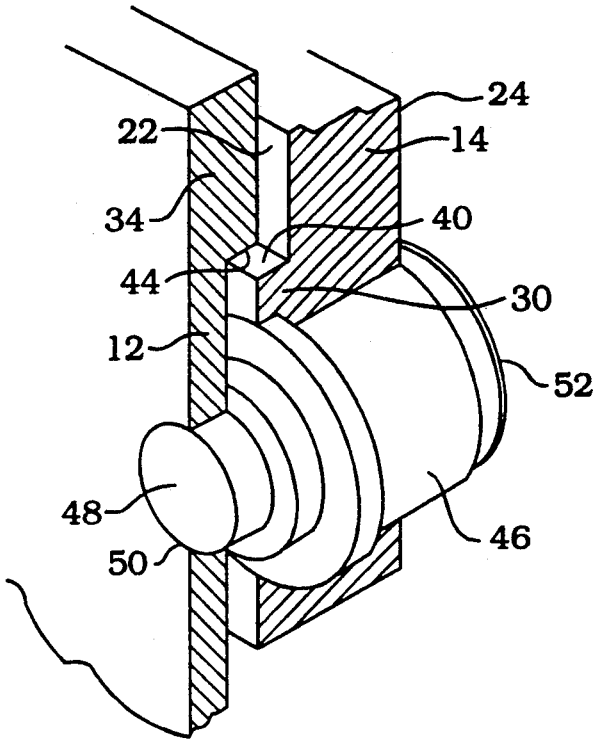
FIG. 2 is perspective view of a pin assembly in its extended state with a partial cross-section view of two tube sections of the FIG. 1 embodiment.
Figure 3:
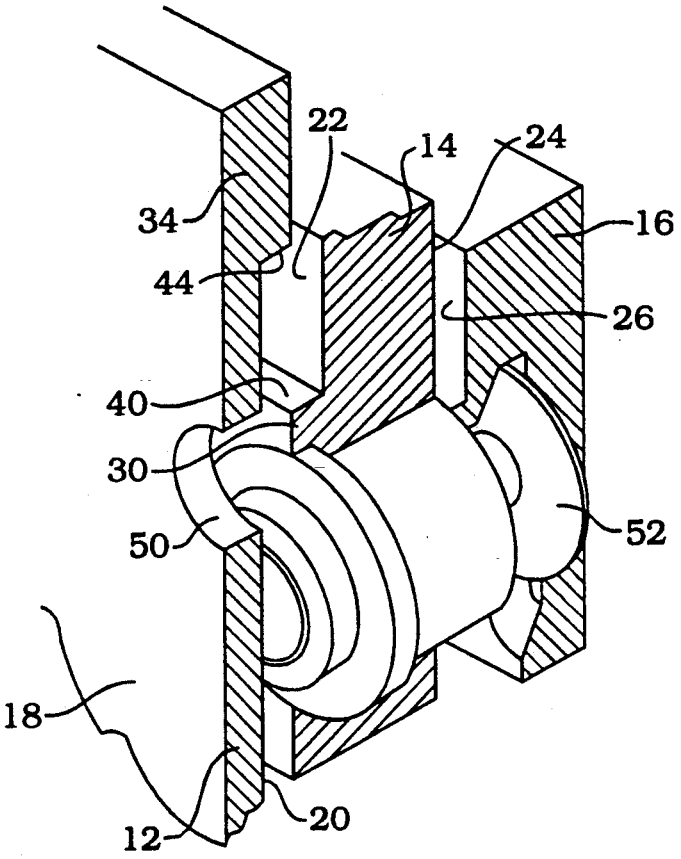
FIG. 3 is perspective view of a pin assembly in its retracted state with a partial cross-section view of three tube sections of the FIG. 1 embodiment.
Figure 4:
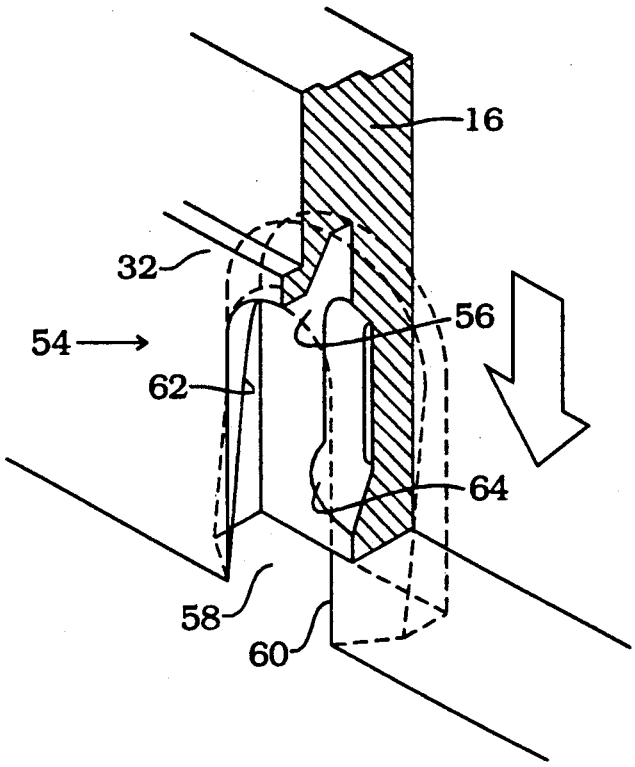
FIG. 4 is a partial cross-section view of a tube section of the FIG. 1 embodiment having a pin head guide therein.

Referring to FIGS. 1-3, the first tubular section 12 comprises a generally hollow cylindrical tube having an exterior wall 18 and an interior wall 20. The second tubular section 14 comprises a generally hollow cylindrical tube having an outer diameter which is smaller than the inner diameter of the first tubular section 12. The second tubular section 14 has an exterior wall 22 and an interior wall 24. The third tubular section 16 comprises a hollow cylindrical tube having an outer diameter which is less than the inner diameter of the second tubular section 14. The third tubular section 16 has an exterior wall 26. The tubular sections 12, 14 and 16 are arrangeable, one-inside-another, such that tubular section 16 may be positioned at least partially inside of tubular section 14 and tubular section 14 may be positioned at least partially inside of tubular section 12. Tubular sections 12, 14 and 16 share a common central axis 27.

While tubular sections 12, 14 and 16 are shown as having generally circular cross-sections, it will be understood that these sections may, alternatively, be formed with oval, square or other polygonal or closed curve cross-sections. With this in mind, the term "tubular" used herein is intended to cover such other embodiments. In addition, the terms "circumference", "circumferential", "diameter" or "radial" used herein are not intended to limit the scope of the invention to tubular sections of circular cross-sections.

The lower end, with respect to FIG. 1, of each tubular section 12, 14 and 16 is provided with an outward extending collar 28, 30 and 32, respectively. These collars are coupled to their respective tubular sections by virtue of being formed integrally with their respective tubular sections or, alternatively, formed as separate pieces attached to their respective tubular sections by any suitable attaching means. In the illustrated embodiment, the collars are shown as being formed integrally with the tubular sections.

The upper edge, with respect to FIG. 1, of each tubular section 12 and 14 is provided with an upper ring 34 and 36, respectively. The upper rings 34 and 36 are coupled to their respective tubular sections by virtue of being formed integrally with their respective tubular sections or, alternatively, formed as separate elements connected to their respective tubular sections by any suitable connecting means. In the illustrated embodiment, upper rings 34 and 36 are shown as being formed integrally with their respective tubular sections 12 and 14

The collars 28, 30 and 32 extend out from the exterior walls 18, 22 and 26, respectively of tubular sections 12, 14 and 16, respectively. Each collar, thereby, defines an upward facing (with respect to FIGS. 1-3) shelf. That is, collar 28 defines a shelf 38, collar 30 defines a shelf 40 and collar 32 defines a shelf 42. The upper rings 34 and 36 extend inward from the interior surfaces 20 and 24, respectively, of tubular sections 12 and 14, respectively. Rings 34 and 36, thereby, each define a downward facing shelf. That is, ring 34 defines downward facing shelf 44 and ring 36 defines another downward facing shelf (not visible in the drawings).

When two adjacent tubular sections are in a deployed state, the shelf defined by the upper ring of the larger diameter tubular section abuts or nearly abuts the shelf defined by the collar of the smaller diameter tubular section. This is shown, for example, in FIGS. 1 and 2, wherein tubular sections 12 and 14 are in a deployed state and wherein shelf 44 of ring 34 abuts shelf 40 of collar 30. In this arrangement, the tubular section 14 above collar 30 is completely outside of tubular section 12 below ring 34, when the tubular sections are in a deployed state. Similarly, when tubular sections 14 and 16 are in a deployed state (FIG. 9) shelf 42 of collar 32 will abut the shelf defined by the upper ring 36 and tubular section 16 above collar 32 will be arranged outside of the tubular section 14 below ring 36. In this manner, when the tubular sections are in a deployed state, overlaps occur only at the collars and rings, and not between two adjacent tubular sections. Thus, in a deployed state, the length of the deployed mast equals the total added length of the tubular length sections above the collars and below the rings.

According to preferred embodiments of the invention, the mast assembly is provided with retractable pin assemblies for selectively locking tubular sections in the deployed state. In the illustrated embodiment, collar 30 is provided with a plurality of retractable pin assemblies 46 around its circumference (two are visible in FIG. 1). The retractable pin assemblies 46 each include a movable pin member 48 which is movable between an extended state (shown in FIGS. 1 and 2) and a retracted state (shown in FIG. 3).

Tubular section 12 is provided with a plurality of pin receiving apertures 50 about its circumference, near the upper ring 34. Apertures 50 are aligned with the pin members 48 of the pin assemblies 46 such that the apertures 50 receive the pin members 48, when the pin members 48 are in their extended state and when the tubular sections 12 and 14 are in their deployed state, as shown in FIGS. 1 and 2. When the pin members 48 are received in the pin receiving apertures 50 (as in FIGS. 1 and 2), the tubular sections 14 and 12 are inhibited from moving with respect to each other and are, therefore, locked in a deployed state. In order to unlock the tubular sections 12 and 14 from their locked, deployed state, pin member 48 may be moved into a retracted position, as shown in FIG. 3.

Referring to FIGS. 2 and 3, pin member 48 is provided with a head 52 facing the central axis 27 of the tubular sections. Head 52 is either connected to or formed integrally with pin member 48 such that when head 52 is pulled toward the central axis 27, pin member 42 is also pulled toward the central axis and is, thus, retracted from its extended state. In the illustrated embodiment, head 52 is pulled toward the central axis to retract pin member 48 by the action of a guide (generally shown at 54 in FIG. 4) in the collar 32 of tubular section 16, as tubular section 16 is moved into a retracted state with respect to tubular section 14.

The guide 54 comprises a compartment 56 formed in the collar 32. The compartment 56 is open at the lower end (with respect to FIG. 4) to form a head receiving aperture 58 in which the head 52 of a pin assembly is received as the tubular section 16 is lowered (with respect to FIG. 1) to its retracted position with respect to tubular section 14. Compartment 56 also has a slot shaped opening 60 through which pin member 48 extends upon head 52 being received within compartment 56. The outer wall of collar 32 at guide 54 is relatively thin near the head receiving aperture 58 and increases in thickness along the length of slot opening 60, so as to form a ramp 62.

Upon head 52 being received in head receiving aperture 58, ramp 62 operates to guide head 52 in the direction toward the central axis 27 of the tubular sections as tubular section 16 is moved into its retracted position with respect to tubular section 14. That is, as relative motion between tubular sections 14 and 16 occurs toward the retracted state of section 16, head 52 enters the head receiving aperture 58 and a surface of head 52 (the surface facing out of the page in FIGS. 2 and 3) rides along ramp 62 so as to pull the pin member 48 toward its retracted position. This motion continues until the head 52 reaches its uppermost position (with respect to the illustrated embodiments) in compartment 56, as shown in FIG. 3. At this position, the pin member 48 is retracted out of pin receiving aperture 50. Further downward motion (with respect to the illustrated embodiments) of tubular section 16 will transfer, through pin assemblies 46, to tubular section 14. Since the pin member 48 has been retracted from the pin receiving apertures 50, tubular section 14 will be free to be moved downward (with respect to the illustrated embodiments) as tubular section 16 is moved downward (with respect to the illustrated embodiments).

Referring to FIG. 1, collar 32 of tubular section 16 is provided with a guide 54 for each pin assembly 46 provided on collar 30 of tubular section 14. While only one guide 54 is shown on collar 32, it will be recognized that a respective guide 54 is provided on collar 32 in alignment with each respective pin assembly 46 in collar 30. In this manner, when a force is applied to tubular section 16 to move the tubular section 16 downward (with respect to FIG. 1) to a retracted state, a respective guide 54 engages each respective pin assembly 46 on collar 30 to, thereby retract the pin member 48 of each pin assembly 46. A further downward (with respect to FIG. 1) acting force on tubular section 16 will transfer, through pin assemblies 46 to tubular section 14. Since the pin members of each pin assembly 46 have been retracted, such further downward acting force will cause tubular section 14 to move downward (with respect to FIG. 1) toward its retracted state with respect to section 12, while section 16 remains in its retracted state with respect to section 14.

The inner wall of compartment 56 is provided with a detent portion 64 for receiving a conical extension 66 provided on the pin head 52. (See FIGS. 5-7.) Upon receiving the conical extension 66 in detent portion 64, the pin assembly operates to lock tubular sections 14 and 16 together in their retracted state. This operation is best described with reference to FIG. 7A and 7B. Referring to FIG. 7A, tubular section 16 has been moved in the direction of arrow 68 and pin head 52 has entered compartment 56 and is being guided by ramp 62. As shown in FIG. 7A head 52 has been guided far enough along the ramp 62 to retract pin member 48 out of aperture 50 in the direction of arrow 70. Further movement of tubular section 16 in the direction of arrow 68 causes, head 52 to be guided by ramp 62 to its furthest position within compartment 56, as shown in FIG. 7B. At this point, pin member 48 is fully retracted, conical extension 66 is received within detent portion 64 and movement of tubular section 16 in the direction of arrow 68 transfers through pin assembly 46 to move tubular section 14 in the direction of arrow 68.

Figure 6A:
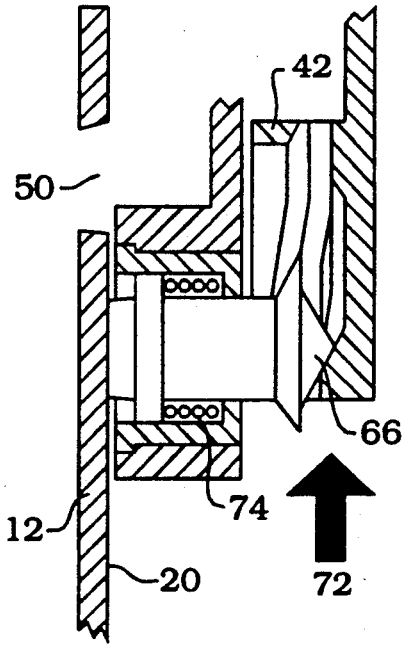
FIGS. 6A and B are partial cross-section views of three tube sections of the FIG. 1 embodiment and a side-view of a pin assembly, showing a mast deployment operation.
Figure 6B:
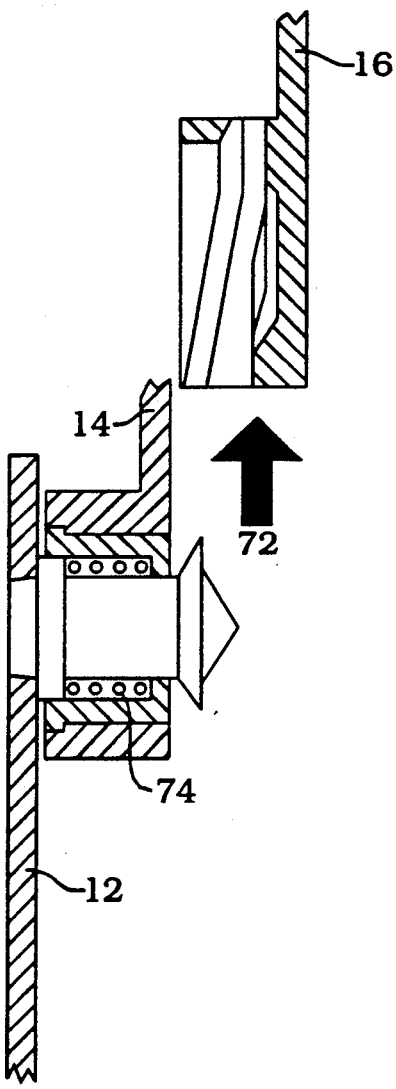

During deployment of the mast, a force is applied to tubular section 16 in the direction of arrow 72 in FIG. 6A. This causes tubular section 16 to move in the direction of arrow 72. Ramp 62 will, thus, ride along pin head 52, in effect allowing pin head 52 to be guided down the ramp 62 to move the pin member 48 toward the interior wall 20 of tubular section 12. Depending upon the frictional force between pin member 48 and interior wall 20, either the engagement of conical extension 66 with the lower end (with respect to FIG. 6A) of detent portion 64 or the engagement of shelf 42 with upper ring 36 will cause further motion of tubular section 16 in the direction of arrow 72 to transfer to motion of tubular section 14 in the direction of arrow 72. Once tubular section 14 is moved to a position wherein pin member 48 aligns with aperture 50, pin member 48 will move to its extended state and extend into aperture 50, by virtue of a spring force provided by spring 74 (see FIG. 6B). At this point, either tubular section 16 has reached its deployed state with resect to tubular section 14 or further deployment force in the direction of arrow 72 will move tubular section 16 to its deployed state with respect to tubular section 14.

Figure 5:
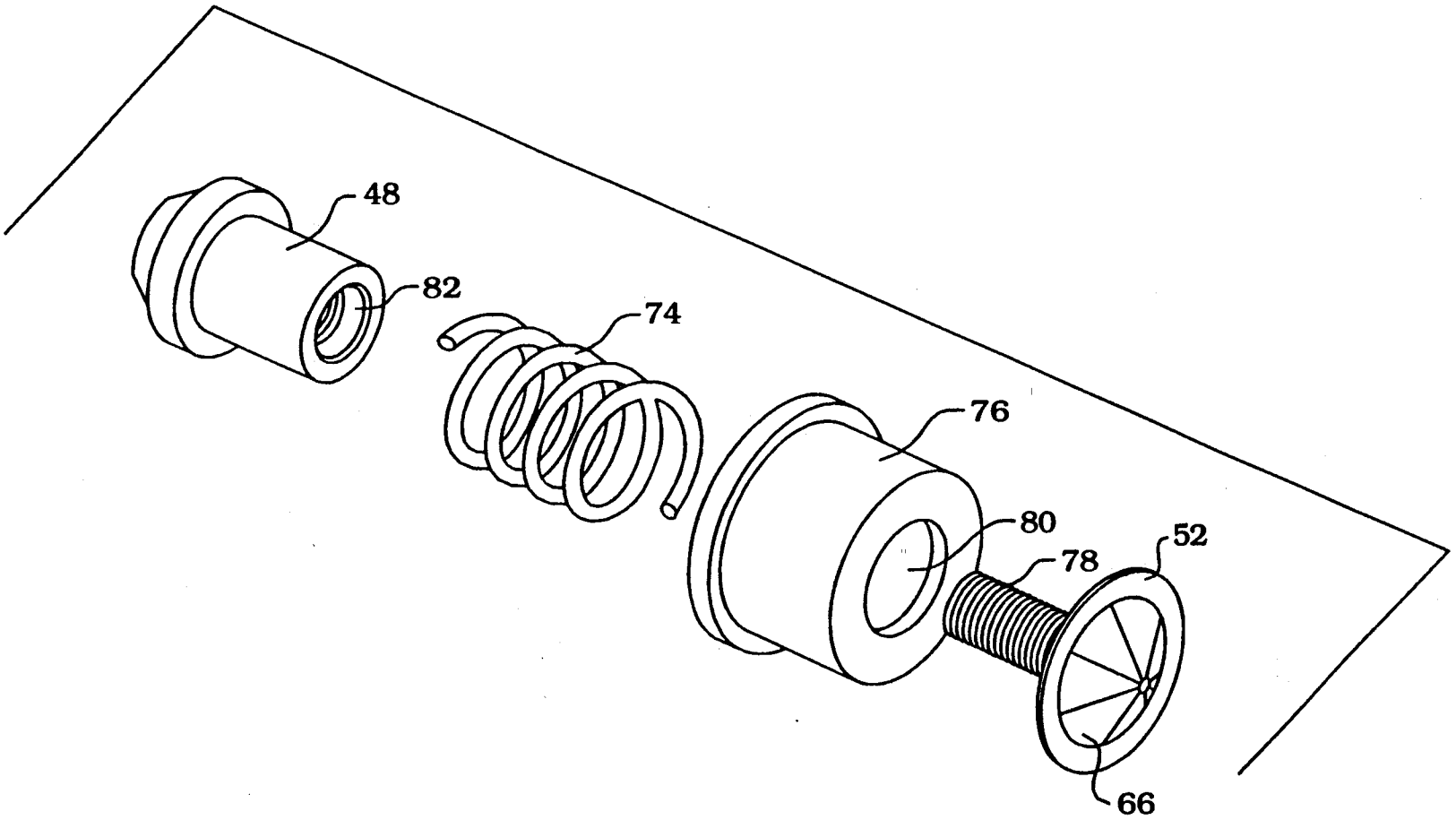
FIG. 5 is an exploded, perspective view of a pin assembly according to an embodiment of the invention.

An embodiment of retractable pin assembly 46 is shown in further detail in FIG. 5. Referring to FIGS. 5 and 2, retractable pin assembly 46 includes a pin member 48, a bias spring 74, a pin head 52 and a cup-shaped body 76. The pin assembly 46 is assembled with pin member 48 extending through spring 74, which is housed within body 76. Head 52 includes a threaded rod 78 which extends through an opening 80 in body 76 and is threaded into a threaded aperture 82 in pin member 48. The body 76 is mounted to collar 30 through an aperture in collar 30.

According to the above description, tubular sections 12, 14 and 16 may be deployed and retracted by exerting a deployment force or retraction force in the directions of arrows 72 and 68 respectively, as shown in FIGS. 6A, 6B, 7A and 7B. It will readily understood that tubular sections 12, 14 and 16 may form the top three tubular sections of a mast having one or more additional tubular sections, provided with retractable pin locking features. That is, collar 28 may be provided with a plurality of retractable pin assemblies 46 and a plurality of guides 54 around its circumference, in alternating fashion, similar to collar 30. In addition, a fourth hollow tubular section may be configured, similar to tubular section 12, but having a larger diameter so as to be able to receive at least a portion of tubular section 12 therein in the manner similar to the receipt of tubular section 14 by tubular section 12. Fifth through Nth tubular sections may be similarly provided to increase the total mast length.

According to a mast embodiment having N tubular sections, the smallest diameter tubular section has a configuration similar to tubular section 16 described above, and the second smallest diameter tubular section will have a configuration similar to tubular section 14 discussed above. The third smallest diameter tubular section will have an array of pin receiving apertures 50 arranged about its circumference, near one end thereof (similar to apertures 50 shown in tubular section 12) and will have a collar having a plurality of retractable pin assemblies 46 and compartments 56, provided in alternating fashion, about its circumference (similar to collar 30) at the opposite end thereof. The fourth smallest diameter tubular section through the (N−1)th smallest diameter tubular section will have a configuration similar to the above described third smallest diameter tubular section. The Nth tubular section will have a plurality of pin receiving apertures 50, but need not have the plurality of retractable pin assemblies and guides, as discussed above. In such a system, the tubular sections are retracted from a deployed state by providing a retraction force on the smallest diameter tubular section so as to draw the smallest diameter tubular section into the interior of the second smallest diameter tubular section. Thereupon, the guides 54 will engage the pin heads 52 of the pin assemblies 46 coupled to the collar of the second smallest diameter tubular section pin members 48 of the pin assemblies 46 will be retracted so as to disengage the pin assemblies 46 from the pin receiving apertures 50 of the third smallest diameter tubular section. Further force in the retracting direction will, thereby, cause the second smallest diameter tubular section to be drawn into the third smallest diameter tubular section, whereupon the guides 54 in the collar of the second smallest diameter tubular section will engage the pin heads 52 coupled to the collar of the third smallest diameter tubular section. This process will continue until each tubular section is drawn into its retracted position in its adjacent larger diameter tubular section. The tubular sections will, thereby, be drawn positively, one at a time, into their retracted positions. A deployment force directed in the opposite direction will deploy each tubular section to each deployed state and will allow the pin members 48 of each retractable pin assembly to extend into the pin receiving apertures 50 of the next largest diameter tubular section to, thereby, lock the tubular sections into a deployed state. Rotational alignment is provided by a guide 84 along the exterior wall of each tubular section and a guide slot 86 in the upper ring of each tubular section.

Deployment occurs sequentially by virtue of the locking interaction of pin head extension 66 and detent 64. That is, the largest diameter movable tubular section will be deployed first, while the smaller diameter tubular sections remain locked in their retracted states by extension 66 and detent 64. Once the pin members of the largest diameter movable tubular section align with pin receiving apertures and, thereafter extend into their extended state, the next largest diameter movable tubular section will be unlocked from its retracted state and will be free to move to a deployed state. In this manner, a sequential deployment occurs wherein the largest diameter movable tubular section deploys first, then the next largest diameter tubular section deploys, and so on. Similarly, by virtue of pin members 48 and apertures 50 acting to lock the tubular sections in a deployed sate, retraction of the tubular members will occur sequentially, beginning with the smallest diameter tubular section.

FIGS. 8 and 9 show multiple tubular section mast assemblies. In FIG. 8, the mast assembly is shown in a fully retracted state. Also shown in FIG. 8 is a portion of a motor drive for driving the tubular sections between retracted and deployed states.

The motor drive, generally indicated at 90, includes a pair of spools 92 and 94. Ribbons 96 and 98 are wound about spools 92 and 94, respectively, and extend from the spools, through roller mechanisms, generally indicated at 100, into the interior of the smallest diameter tubular section. The ribbons 96 and 98 are attached to the smallest diameter tubular section at 102. The ribbons 96 and 98 are made of a semi-flexible material, such as a thin spring metal or composite material which may be wound about the spools 92 and 94 and bent by roller mechanisms 100 as shown in FIG. 8. Roller mechanisms 100 force the ribbons to bend in an arc about their width. Such bending of the ribbons increases the rigidity of the ribbons along their length. In this manner, ribbons 96 and 98 have enough rigidity upon passing roller mechanisms 100 to transfer a drive force to drive the tubular sections from the retracted states to the deployed state. Similarly, as the spools are wound, the ribbons 96 and 98 draw the tubular sections into a retracted state. Spools 92 and 94 are driven by a conventional electric motor and gear arrangement. This type of drive mechanism is referred to as a bi-stem actuator. During periods of deployment, the stability of the mast is enhanced by the stiffness of the bi-stem actuator.

Other types of deployment or deployment/retraction devices may be used as an alternative to the preferred motor drive system shown in FIG. 8. For example, any suitable conventional linear actuator may be employed. Alternatively, a pneumatic actuator system may be used.

In the preferred system, the deployment or deployment/retraction device is connected to the free end of the smallest diameter tubular section. For example, note the connection of ribbons 96 and 98 to the smallest diameter section, at 102, near the upper end of the tubular section in FIG. 8. This provides a deployment or retraction force at the upper end of the smallest diameter tube, which, in effect, results in a pulling force for readily pulling the tubular sections into deployed retracted states. However, in other embodiments, the deployment/retraction device may be connected at other locations along the lengths of the tubular sections.

Further improvements of the above discussed embodiments include the use of tapered pin members and tapered pin receiving holes, to resolve play in the joint and to allow the pin members to have looser tolerances in seating in their respective apertures. In addition, to decrease wear and deployment friction, the entire mast and pin assemblies may be treated with a friction reducing coating, such as an electroless nickel-Teflon coating. Further embodiments may be designed to deploy, but not retract, in which case, the drive mechanism may be designed to only drive the mast into deployment.

According to the above discussed embodiments, the use of circumferentially distributed pins within a collar provided at the end of a tubular section and pin receiving holes provided near an end of various tube sections provides an alternative approach to tube overlap for bending strength. The contact surface between the inner and outer tubes during deployment may be reduced to the pin tip area. Tip deflection becomes a function of pin and pin hole clearance and compliance rather than the gap space between tubes. From a manufacturing standpoint, the ability to precisely fabricate pins and pin holes is far superior than the ability to manufacture accurate thin-walled tubing. If governed only by the friction between the pins and tube walls, it is possible for all tubes to be simultaneously deployed by different amounts. If it is necessary to sequentially latch the outermost tubes of the nested stack in order to have a dynamically predictable structure during all portions of deployment, a detent feature may be provided within the pin head guide. A cone shaped head of the pin rides within the pin head guide. In the event of spring failure, the pin members are inserted into the pin receiving holes by engagement of the conical pin head with the end of the detent portion of the guide. Additionally, in the event of multiple particle strikes from orbiting debris or attack, the multiplicity of engaging members makes catastrophic failure unlikely and, thus, the structure may be damage tolerant.

Various suitable materials may be used for the tubular sections, including composite materials such as epoxy and graphite, fiberglass, carbon-carbon composites to name a few. Various suitable metal alloys or pure metals may also be used.

A first example model was built with five tubular sections, each of 24 inches in length. The inside diameters of the tubular sections were 3.440, 3.940, 4.440, 4.940 and 5.440 inches, respectively. Machined from thick-walled aluminum tubes, the wall thicknesses were reduced to 0.02 inch for the main portion of the tubular sections and 0.25 inch for the collar portion. The pin assembly was constructed from steel and included a two-piece pin/conic and housing cup. An upper ring, attached to each tube for stability during deployment, features a clocking strip slot machined to the inner diameter. The clocking strips, fastened to the tubes by rivets and epoxy, provided alignment for the pin head guide feature. To increase the load bearing surface while reducing the retraction force, a tapered design was used in both the pin tip and the pin receiving hole. Particularly, for the hole, a specially designed cold forming tool was used to radially compress the material into a 5-degree taper. To decrease wear and deployment friction, the entire mast and pin assemblies were treated with electroless nickel-Teflon coating.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to embrace therein.

What is claimed is:

1. A mast assembly comprising:

a plurality of tubular sections of mutually different outer diameters arrangeable one inside another and sequentially movable in a telescoping manner between a retracted state and a deployed state, each tubular section having first and second ends, the tubular sections defining a variable mast length from the first end of the smallest diameter tubular section to the second end of the largest end of the tubular section, the mast length being greater in the deployed state than in the retracted state;

at least one guide member provided on one of the tubular sections;

at least one guide slot provided on another one of said tubular sections and arranged to engage the at least one guide member on said one tubular section as the tubular sections are moved between retracted and deployed states; and at least one retractable member having a retracted state and an extended state, the at least one retractable member being coupled to at least one tubular section;

wherein at least one tubular section adjacent each tubular section having the at least one retractable member coupled thereto is provided with at least one receptacle for receiving a portion of the retractable member, the at least one receptacle having a dimension suitable for receiving the retractable member when the retractable member is in its extended state;

wherein each receptacle receives an extended retractable member upon the tubular sections being arranged in the deployed state.

2. A mast assembly comprising:

a first hollow tubular section having first and second ends and an interior wall;

a second hollow tubular section having first and second ends, an exterior wall and an interior wall, the second tubular section being arrangeable at least partially within the interior wall of the first tubular section and adjacent the first tubular section;

a third tubular section having first and second ends and an exterior wall, the third tubular section being arrangeable at least partially within the interior wall of the second tubular section and adjacent the second tubular section;

the tubular sections being movable between deployed and retracted states, wherein when in the deployed state, the second and third tubular sections are positioned adjacent the first and second tubular sections, respectively, and in the retracted state, the second and third tubular sections are positioned at least partially within the first and second tubular sections, respectively;

at least one retractable member coupled to the second tubular section adjacent the second end thereof, each retractable member having extended and retracted states, wherein when in the extended state, each retractable member extends out from the exterior wall of the second tubular section by a greater distance relative to the retracted state; and a guide disposed to engaging each retractable member and guide each engaged retractable member from its extended state to its retracted state upon moving the third tubular section into its retracted state;

wherein the first tubular section has at least one receptacle in its interior wall for receiving the at least one retractable member upon the at least one retractable member being in the extended state; and wherein when the at least one retractable member is in the retracted state, the second tubular section is movable relative to the first tubular section and, when the at least one retractable member is in the extended state and received within the at least one receptacle, the at least one retractable member inhibits movement of the second tubular section relative to the first tubular section.

3. A mast assembly as recited in claim 2, wherein when the tubular sections are in the deployed state, the first end of the first tubular section is adjacent the second end of the second tubular section and the first end of the second tubular section is adjacent the second end of the third tubular section and, wherein when the tubular sections are in their retracted states, the first end of the first and third tubular sections are adjacent the first end of the second tubular section.

4. A mast assembly as recited in claim 2, wherein the guide is provided on the exterior wall of the third tubular tubular section.

5. A mast assembly as recited in claim 2, wherein the at least one retractable member comprises a plurality of pin assemblies circumferentially arranged about the second tubular section and, wherein the at least one receptacle in the first tubular section comprises a plurality of pin receiving apertures circumferentially arranged about the first tubular section.

6. A mast assembly as recited in claim 2, wherein the first tubular section has an exterior wall defining an exterior diameter, the mast assembly further comprising a fourth hollow tubular section having first and second ends and an interior wall, the first tubular section being arrangeable at least partially within the interior wall of the fourth tubular section and adjacent the fourth tubular section, wherein when in the deployed state, the first tubular section is positioned adjacent the fourth tubular section and when in the retracted state, the first tubular section is positioned at least partially within the fourth tubular section.

7. A mast assembly as recited in claim 2, wherein the first tubular section has an interior wall, the mast assembly further comprising fourth-Nth hollow tubular sections, each having first and second ends and an interior wall, the first tubular section being arrangeable at least partially within the interior wall of the fourth tubular section and adjacent the fourth tubular section and the fourth through (N−1)th tubular sections being similarly arrangeable within the interior walls of the fifth through Nth tubular sections, respectively, wherein in the deployed state, the first tubular section is positioned adjacent the fourth tubular section and the fourth through (N−1)th tubular sections are positioned adjacent the fifth through Nth tubular sections, respectively, and when in the retracted state, the first tubular section is positioned at least partially within the fourth tubular section and the fourth through (N−1)th tubular sections are positioned at least partially within the fifth through Nth tubular sections, respectively.

8. A mast assembly as recited in claim 2, further comprising means for imparting a force on the first end of the third tubular section for moving the third tubular section into a deployed state with respect to the second tubular section and, upon the at least one retractable member being extended into its extended state, for moving the second tubular section into its deployed state with respect to the first tubular section.

9. A mast assembly comprising:

a first hollow tubular section having first and second ends and an interior wall;

a second hollow tubular section having first and second ends, an exterior wall and an interior wall, the second tubular section being arrangeable at least partially within the interior wall of the first tubular section and adjacent the first tubular section;

a third tubular section having first and second ends and an exterior wall, the third tubular section being arrangeable at least partially within the interior wall of the second tubular section and adjacent the second tubular section;

the tubular sections being movable between deployed and retracted states, wherein when in the deployed state, the second and third tubular sections are positioned adjacent the first and second tubular sections, respectively, and in the retracted state, the second and third tubular sections are positioned at least partially within the first and second tubular sections, respectively;

at least one retractable pin coupled to the second tubular section adjacent the second end thereof, each retractable pin having a first end facing inward of the second tubular section and a head provided at the first end, each retractable member having extended and retracted states, wherein when in the extended state, the retractable member extends out from the exterior wall of the second tubular section by a greater distance relative to the retracted state; and at least one guide on the third tubular section, positioned to guide the head of the pin of each retractable member further into the interior of the second to retract the pin toward its retracted state as the third tubular section is moved into the retracted position;

wherein the first tubular section has at least one receptacle in its interior wall for receiving the at least one retractable pin upon the at least one retractable pin being in the extended state;

wherein when the at least one retractable pin is in the retracted state, the second tubular section is movable relative to the first tubular section and, when the at least one retractable pin is in the extended state and received within the at least one receptacle, the at least one retractable pin inhibits movement of the second tubular section relative to the first tubular section.

10. A mast assembly comprising:

a first hollow tubular section having first and second ends and an interior wall;

a second hollow tubular section having first and second ends, an exterior wall and an interior wall, the second tubular section being arrangeable at least partially within the interior wall of the first tubular section and adjacent the first tubular section;

a third tubular section having first and second ends and an exterior wall, the third tubular section being arrangeable at least partially within the interior wall of the second tubular section and adjacent the second tubular section;

the tubular sections being movable between deployed and retracted states, wherein when in the deployed state, the second and third tubular sections are positioned adjacent the first and second tubular sections, respectively, and in the retracted state, the second and third tubular sections are positioned at least partially within the first and second tubular sections, respectively;

at least one retractable member coupled to the second tubular section adjacent the second end thereof, each retractable member having extended and retraced states, wherein when in the extended state, the retractable member extends out from the exterior wall of the second tubular section by a greater distance relative to the retracted state; and means for retracting each retractable member from its extended state to its retracted state upon moving the third tubular section into its retracted state;

wherein the first tubular section has at least one receptacle in its interior wall for receiving the at least one retractable member upon the at least one retractable member being in the extended state;

wherein when the at least one retractable member is in the retracted state, the second tubular section is movable relative to the first tubular section and, when the at least one retractable member is in the extended state and received within the at least one receptacle, the at least one retractable member inhibits movement of the second tubular section relative to the first tubular section;

wherein a collar is coupled to the second tubular section and has an aperture therethrough for each retractable member; and wherein each retractable member comprises:

a pin extending within an aperture in the collar and having a first end facing the first tubular section, a second end facing the third tubular section and a pin body extending between the first and second pin ends;

a spring biasing the pin in the direction outward from the exterior wall of the second tubular section; and a head extending from the second pin end, the head having a dimension larger than the aperture in the collar to inhibit the pin from passing through the collar aperture in the spring biasing direction.

11. A mast assembly as recited in claim 10, wherein the means for retracting each retractable member comprises at least one guide on the third tubular section and positioned to guide the head of each pin inward of the diameter defined by the interior wall of the second tubular section as the third tubular section is moved into the retracted position.

12. A mast assembly comprising:

a first hollow tubular section having first and second ends and an interior wall;

a second hollow tubular section having first and second ends, an exterior wall and an interior wall, the second tubular section being arrangeable at least partially within the interior wall of the first tubular section and adjacent the first tubular section;

a third tubular section having first and second ends and an exterior wall, the third tubular section being arrangeable at least partially within the interior wall of the second tubular section and adjacent the second tubular section;

the tubular sections being movable between deployed and retracted states, wherein when in the deployed state, the second and third tubular sections are positioned adjacent the first and second tubular sections, respectively, and in the retracted state, the second and third tubular sections are positioned at least partially within the first and second tubular sections, respectively;

a plurality of retractable pin assemblies circumferentially arranged about the second tubular section and coupled to the second tubular section adjacent the second end thereof, each pin assembly having extended and retraced states, wherein when in the extended state, the pin assemblies extend out from the exterior wall of the second tubular section by a greater distance relative to the retracted state, each retractable pin assembly comprises a pin having a first end facing the exterior wall of the third tubular section and a head provided at the first end;

a plurality of guides circumferentially arranged about the exterior wall of the third tubular section and positioned to guide the head of the pin of each retractable pin assembly inward of the interior wall of the second tubular section toward the pin's retracted state as the third tubular section is moved into the retracted position;

wherein the first tubular section has a plurality of pin receiving apertures circumferentially arranged about the first tubular section in the interior wall of the first tubular section, for receiving the plurality of pin assemblies upon the pin assemblies being in their extended states;

wherein when the retractable pin assemblies are in their retracted states, the second tubular section is movable relative to the first tubular section and, when the retractable pin assemblies are in their extended states and received within the pin receiving apertures, the pin assemblies inhibit movement of the second tubular section relative to the first tubular section.

13. A mast assembly comprising:

a first hollow tubular section having first and second ends and an interior wall;

a second hollow tubular section having first and second ends, an exterior wall and an interior wall, the second tubular section being arrangeable at least partially within the interior wall of the first tubular section and adjacent the first tubular section;

a third tubular section having first and second ends and an exterior wall, the third tubular section being arrangeable at least partially within the interior wall of the second tubular section and adjacent the second tubular section;

the tubular sections being movable between deployed and retracted states, wherein when in the deployed state, the second and third tubular sections are positioned adjacent the first and second tubular sections, respectively, and in the retracted state, the second and third tubular sections are positioned at least partially within the first and second tubular sections, respectively;

at least one retractable member coupled to the second tubular section adjacent the second end thereof, each retractable member having extended and retraced states, wherein when in the extended state, the retractable member extends out from the exterior wall of the second tubular section by a greater distance relative to the retracted state; and means for retracting each retractable member from its extended state to its retracted state upon moving the third tubular section into its retracted state;

wherein the first tubular section has at least one receptacle in its interior wall for receiving the at least one retractable member upon the at least one retractable member being in the extended states; and wherein when the at least one retractable member is in the retracted state, the second tubular section is movable relative to the first tubular section and, when the at least one retractable member is in the extended state and received within the at least one receptacle, the at least one retractable member inhibits movement of the second tubular section relative to the first tubular section;

said mast assembly further comprising locking means for locking the second the third tubular sections together when the third tubular section is in its retracted state relative to the second tubular section; and means for releasing the locking means upon the second tubular member being moved into its deployed state relative to the first tubular members.

14. A mast assembly as recited in claim 13, wherein the locking means comprises an extension portion extending from each retractable member toward the interior of the second tubular section and an extension receptacle on the third tubular section for receiving the extension portion of each retractable member upon each retractable member being in its retracted state and upon the third tubular section being in its retracted state relative to the second tubular section.

15. A mast assembly comprising:

a first hollow tubular section having first and second ends and an interior wall;

a second hollow tubular section having first and second ends, an exterior wall and an interior wall, the second tubular section being arrangeable at least partially within the interior wall of the first tubular section and adjacent the first tubular section;

a third tubular section having first and second ends and an exterior wall, the third tubular section being arrangeable at least partially within the interior wall of the second tubular section and adjacent the second tubular section;

the tubular sections being movable between deployed and retracted states, wherein when in the deployed state, the second and third tubular sections are positioned adjacent the first and second tubular sections, respectively, and in the retracted state, the second and third tubular sections are positioned at least partially within the first and second tubular sections, respectively;

at least one retractable member coupled to the second tubular section adjacent the second end thereof, each retractable member having extended and retraced states, wherein when in the extended state, the retractable member extends out from the exterior wall of the second tubular section by a greater distance relative to the retracted state; and means for retracting each retractable member from its extended state to its retracted state upon moving the third tubular section into its retracted state;

wherein the first tubular section has at least one receptacle in its interior wall for receiving the at least one retractable member upon the at least one retractable member being in the extended states;

wherein when the at least one retractable member is in the retracted state, the second tubular section is movable relative to the first tubular section and, when the at least one retractable member is in the extended state and received within the at least one receptacle, the at least one retractable member inhibits movement of the second tubular section relative to the first tubular section; and said assembly further comprising locking means for locking the second the third tubular sections together when the third tubular section is in its retracted state relative to the second tubular section; and means for releasing the locking means upon the second tubular section being moved into its deployed state relative to the first tubular section;

means for applying a force to at least one of the tubular sections for moving the tubular sections from their retracted states to their deployed states, wherein the locking means operates to control deployment in a sequential manner such that the second tubular section moves to its deployment state before the locking means locking the second and third tubular sections is released.

16. A mast assembly comprising:

a plurality of tubular sections nested one-in-another and movable in a telescoping manner between retracted and deployed states, the tubular sections including an inner tubular section, an outer tubular section and at least one middle tubular section disposed between the inner and outer tubular sections upon the tubular sections being in the retracted state;

means for locking the at least one middle tubular section to the inner tubular section upon the plural tubular sections being in the retracted state;

means for releasing the locking means upon the middle tubular section being in a deployed state with respect to the outer tubular section such that movement of the tubular sections from retracted to deployed states occurs sequentially wherein the middle tubular section moves to a deployed state before the inner tubular section moves to a deployed state.

17. A mast assembly comprising:

a plurality of tubular sections nested one-in-another and movable in a telescoping manner between retracted and deployed states, the tubular sections including first and third tubular sections and a second tubular section disposed between the first and third tubular sections upon the tubular sections being in the retracted state;

at least one retractable member having a retracted state and an extended state, the at least one retractable member being coupled to the second tubular section, the at least one retractable member having a first end facing the first tubular section, a second end facing the second tubular section and a head extending from the second end, the head having a further extension extending toward the third tubular section;

means for moving the at least one retractable member inward with respect to the second tubular member to move the at least one retractable member to its retracted state upon the third tubular section being moved to its retracted state relative to the second tubular member;

at least one receptacle on the third tubular section for receiving the second end of the at least one retractable member upon the third tubular section being in the retracted state with relative to the second tubular section.

18. A mast assembly as recited in claim 17, wherein the second end of the at least one retractable member has a head and a further extension extending toward the third tubular section and wherein the means for moving the at least one retractable member comprises a guide on the third tubular section for guiding the head of the at least one retractable member inward with respect to the second tubular member, and wherein the at least one receptacle on the third tubular section receives the further extension of the at least one retractable member upon the third tubular section being in the retracted state relative to the second tubular section.

19. A mast assembly as recited in claim 18, wherein:

the third tubular member is provided with a collar portion;

the at least one guide comprises a compartment provided in the collar portion and defines a ramp for guiding the head of the at least one retractable member; and the at least one receptacle on the third tubular section comprises a detente provided in the at least one compartment for receiving the further extension and inhibiting movement of the third tubular section to its deployed state relative to the second tubular section upon the at least one retractable member being in its retracted state.

20. A mast assembly as recited in claim 19, wherein the at least one retractable member comprises a plurality of retractable pins arranged about the circumference of the second tubular section and wherein the further extension of the head of the at least on retractable member comprises a conical portion extending from the head of each retractable pin.

21. A mast assembly as recited in claim 18, wherein the at least one retractable member comprises a plurality of retractable pins arranged about the circumference of the second tubular section and wherein the further extension of the head of the at least on retractable member comprises a conical portion extending from the head of each retractable pin.

22. A method of moving mast assembly sections between retracted and employed states, comprising the steps of:

arranging first, second and third tubular sections one-in-another, in a retracted state, with the third tubular section arranged within the second tubular member and with the second tubular section arranged within the first tubular section;

locking the second and third tubular sections together in the retracted state;

moving the second tubular section to its deployed state relative to the first tubular section while the second and third tubular sections remained locked to each other;

releasing the lock of the second and third tubular sections upon the second tubular section being in the deployed state with respect to the first tubular section; and moving the third tubular section to its deployed state relative to the second tubular section upon release of the lock of the second and third tubular sections.

23. A method of moving mast assembly sections between retracted and deployed states, comprising the steps of:

arranging first, second and third tubular sections one-in-another, in a retracted state, with the third tubular section arranged within the second tubular member and with the second tubular section arranged within the first tubular section;

securing the second and third tubular sections together in the retracted state;

moving the second tubular section to its deployed state relative to the first tubular section while the second and third tubular sections remained locked to each other;

releasing the lock of the second and third tubular sections upon the second tubular section being in the deployed state with respect to the first tubular section; and moving the third tubular section to its deployed state relative to the second tubular section upon release of the securement of the second and third tubular sections.

wherein the step of securing the second and third tubular sections comprises the step of extending a rigid member coupled to the second tubular section into a receptacle provided on the third tubular section; and the step of releasing the securement comprises the step of moving the rigid member out of the receptacle provided in the third tubular section.

24. A method as recited in claim 23, wherein the step of moving the rigid member out of the receptacle in the third tubular section comprises the step of moving the rigid member into a receptacle provided in the first tubular section to secure the first and second tubular sections together.

25. A method of moving mast assembly sections between retracted and deployed states, comprising the steps of:

arranging first, second and third tubular sections one-in-another, in a retracted state, with the third tubular section arranged within the second tubular member and with the second tubular section arranged within the first tubular section;

securing the second and third tubular sections together in the retracted state;

moving the second tubular section to its deployed state relative to the first tubular section while the second and third tubular sections remained secured to each other;

releasing the securement of the second and third tubular sections upon the second tubular section being in the deployed state with respect to the first tubular section; and moving the third tubular section to its deployed state relative to the second tubular section upon release of the securement of the second and third tubular sections.

wherein the step of securing the second and third tubular sections comprises the step of engaging a plurality of pins slidably coupled to the second tubular section with a corresponding plurality of detents provided in the third tubular section; and the step of releasing the securement comprises the step of sliding the pins with respect to the second tubular section out of engagement with the detents in the third tubular section.

26. A method as recited in claim 25, wherein the step of sliding the pins out of engagement with the detentes in the third tubular section comprises the step of sliding the plurality of pins with respect to the second tubular section into engagement with a corresponding plurality of detentes in the first tubular section to secure the first and second tubular sections together.

27. A method of moving mast assembly sections between deployed and retracted states, comprising the steps of arranging first, second and third tubular sections in a telescoping arrangement with the first tubular section adjacent the second tubular section and the second tubular section adjacent the third tubular section in a deployed state;

locking the first and second tubular sections together in the deployed state;

moving the third tubular section into the second tubular section toward its retracted state with respect to the second tubular section while the second and first tubular sections remain locked to each other;

releasing the lock of the first and second tubular sections upon the third tubular section being in the retracted state with respect to the second tubular section;

moving the second tubular section into the first tubular section toward its retracted state with respect to the first tubular section upon release of the lock of the second and third tubular sections.

28. A method as recited in claim 27, wherein the step of securing the second and third tubular sections comprises the step of extending a rigid member coupled to the second tubular section into a receptacle provided on the first tubular section; and the step of releasing the securement comprises the step of moving the rigid member out of the receptacle in the first tubular section.

29. A method of moving mast assembly sections between deployed and retracted states, comprising the steps of arranging first, second and third tubular sections in a telescoping arrangement with the first tubular section adjacent the second tubular section and the second tubular section adjacent the third tubular section in a deployed state;

securing the first and second tubular sections together in the deployed state;

moving the third tubular section into the second tubular section toward its retracted state with respect to the second tubular section while the second and first tubular sections remain secured to each other;

releasing the securement of the first and second tubular sections upon the third tubular section being in the retracted stated with respect to the second tubular section;

moving the second tubular section into the first tubular section toward its retracted state with respect to the first tubular section upon release of the securement of the second and third tubular sections;

wherein the step of securing the second and third tubular section comprises the step of extending a rigid member coupled to the second tubular section into a receptacle provided to the first tubular section;

wherein the step of releasing the securement comprises the step of moving the rigid member out of the receptacle in the first tubular section;

wherein the rigid member comprises a movable pin having a head directed toward the interior of the second tubular sections; and wherein the step of moving the rigid member out of the receptacle in the first tubular section comprises the step of guiding the pin head further into the interior of the second tubular section with a guide member provided on the third tubular section.

* * * * *